US006849231B2

(12) United States Patent
Kojima et al.

(10) Patent No.: US 6,849,231 B2
(45) Date of Patent: Feb. 1, 2005

(54) α-β TYPE TITANIUM ALLOY

(75) Inventors: Soichiro Kojima, Takasago (JP); Hideto Oyama, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 226 days.

(21) Appl. No.: 10/256,709

(22) Filed: Sep. 30, 2002

(65) Prior Publication Data

US 2003/0098099 A1 May 29, 2003

(30) Foreign Application Priority Data

Oct. 22, 2001 (JP) ..... 2001-324075

(51) Int. Cl.[7] ..... C22C 14/00
(52) U.S. Cl. ..... 420/417; 420/420; 420/421
(58) Field of Search ..... 420/417, 420, 420/421

(56) References Cited

U.S. PATENT DOCUMENTS

| | | | | |
|---|---|---|---|---|
| 2,726,954 A | | 12/1955 | Jaffee et al. | |
| 3,986,868 A | | 10/1976 | Crossley | |
| 5,509,979 A | * | 4/1996 | Kimura | 148/421 |
| 5,759,484 A | * | 6/1998 | Kashii et al. | 420/420 |

FOREIGN PATENT DOCUMENTS

| | | |
|---|---|---|
| EP | 0 851 036 | 7/1998 |
| EP | 0 969 109 | 1/2000 |
| GB | 880470 | 10/1961 |
| GB | 1 023 284 | 3/1966 |
| GB | 1 079 416 | 8/1967 |

OTHER PUBLICATIONS

ASM Handook, vol. 2, Properties and Selection: Nonferrous Alloys and Special–Purpose Materials, 1990, pp. 592–605.*
N. Machida, et al., Materials Science Forum, vol. 357–359, pp. 539–544, XP–002226170, "Grain Refinement and Superplasticity of Reaction Sintered TiC Dispersed Ti Alloy Composites Using Hydrogenation Treatment", 2001.

* cited by examiner

*Primary Examiner*—Daniel Jenkins
(74) *Attorney, Agent, or Firm*—Oblon, Spivak, McClelland, Maier & Neustadt, P.C.

(57) ABSTRACT

There is provided an α-β type titanium alloy having a normal-temperature strength equivalent to, or exceeding that of a Ti-6Al-4V alloy generally used as a high-strength titanium alloy, and excellent in hot workability including hot forgeability and subsequent secondary workability, and capable of being hot-worked into a desired shape at a low cost efficiently. There is disclosed an α-β type titanium alloy having high strength and excellent hot workability wherein 0.08–0.25% C is contained, the tensile strength at room temperature (25° C.) after annealing at 700° C. is 895 MPa or more, the flow stress upon greeble test at 850° C. is 200 MPa or less, and the tensile strength/flow stress ratio is 9 or more. A particularly preferred α-β type titanium alloy comprises 3–7% Al and 0.08–025% C as α-stabilizers, and 2.0–6.0% Cr and 0.3–1.0% Fe as β-stabilizers.

13 Claims, 7 Drawing Sheets

α-β TYPE TITANIUM ALLOY

BACKGROUND OF THE INVENTION

1. Field of the Invention

The present invention relates to a titanium alloy which exhibits high strength in an operating temperature range and is excellent in hot workability because of its small flow stress at high temperatures. The titanium alloy can be widely utilized in the fields of, for example, the aircraft industry, the automobile industry, and the ship industry, taking advantage of its high strength and excellent hot workability.

2. Description of Related Art

α-β type titanium alloys typified by a Ti-6Al-4V alloy are light in weight, and have high strength and excellent corrosion-resistance. For this reason, the alloys have been positively put into practical use as structural materials, shell plates, an the like, serving as alternatives to steel materials in various fields of the aircraft, automobile, and ship industries, and other industries.

However, the high-strength titanium alloys are inferior in forgeability and secondary workability because of the high flow stress in the α-β temperature range, i.e., in the hot working temperature range, which is a large obstacle in pursuing the generalization thereof. For this reason, the number of working steps and the number of heating steps during hot working are increased, so that an enough excess metal is given at the sacrifice of the product yield. Under such conditions, hot working is actually performed. Even when hot press forming is performed, the limit size of the applicable pressing capability is accepted. Further, even when an alloy is hot rolled into a rod form or a linear form, if high-speed rolling is adopted, a large working heat generation occurs due to the large flow stress, which causes structure defects. Therefore, it can not but to roll the alloy at a low speed, which is a large obstacle in enhancing the productivity.

SUMMARY OF THE INVENTION

In view of the foregoing circumstances, the present invention has been completed. It is therefore an object of the present invention to provide a titanium alloy which has an ordinary-temperature strength equivalent to, or exceeding that of a Ti-6Al-4V alloy most widely used as a high-strength titanium alloy at present, and is excellent in hot workability including hot forgeability and the subsequent secondary workability, and hence is capable of being subjected to hot working into a desired shape at a low cost and with efficiency.

According to first aspect of the invention, an α-β type titanium alloy, which has been able to overcome the foregoing problem, includes C in an amount of 0.08 to 0.25 mass %, wherein the ratio between the tensile strength at 25° C. after annealing at 700° C. and the flow stress upon greeble test at 850° C. is not less than 9.

According to second aspect of the invention, in the α-β type titanium alloy of the first aspect, it is desirable that the tensile strength at 500° C. after annealing at 700° C. is not less than 45% of the tensile strength at a room temperature of 25° C.

According to third aspect of the invention, a desirable composition of the α-β type titanium alloy of the first aspect further includes, in addition to 0.08 to 0.25 mass % C, Al in an amount of 4 to 5.5 mass %, and a β-stabilizer in an amount enough for the tensile strength at 25° C. after annealing at 700° C. to be not less than 895 MPa.

According to fourth aspect of the invention, if the desirable embodiment of the α-β type titanium alloy of the first aspect is defined from another viewpoint, the peritectoid reaction temperature in a pseudo-binary system phase diagram of the titanium alloy as a base and C is more than 900° C.

According to fifth aspect of the invention, in the α-β type titanium alloy of the first aspect, it is desirable that the amount of C contained in the alloy is not less than the solubility limit in β phase at the peritectoid reaction temperature in the pseudo-binary system phase diagram of the titanium alloy as a base and C, and less than the C amount in the peritectoid composition.

With the foregoing configuration, it is possible to implement a titanium alloy having both high ordinary-temperature strength and excellent hot workability.

According to sixth aspect of the invention, if the desirable embodiment of the α-β type titanium alloy of the first aspect is defined from a still other viewpoint, the maximum particle size of TiC present in a titanium alloy matrix is not more than 15 μm, and the area ratio of the TiC is not more than 3%. As a result, it is possible to impart favorable fatigue characteristic thereto.

According to seventh aspect of the invention, such an α-β type titanium alloy of favorable fatigue characteristic can be implemented in the following manner. For example, prior to annealing at 700 to 900° C., hot working is performed such that the total heating time at 900° C. to the peritectoid reaction temperature is not less than 4 hours, and such that the total reduction is not less than 30%.

According to eighth aspect of the invention, if the desirable composition is further specifically defined in the α-β type titanium alloy of the first aspect, it further includes, in addition to 0.08 to 0.25 mass % C, Al in an amount of 3.0 to 7.0 mass %, and a β-stabilizer in a Mo equivalence of 3.25 to 10 mass %. In this case, the Mo equivalence is defined as follows:

$$\text{Mo equivalence}=\text{Mo(mass \%)}+(1/1.5)\text{V(mass \%)}+1.25\ \text{Cr(mass \%)}+2.5\ \text{Fe(mass \%)}.$$

According to ninth aspect of the invention, in the α-β type titanium alloy of the eighth aspect, it is preferable that Cr and Fe are contained in an amount of 2.0 to 6.0 mass % and in an amount of 0.3 to 2.0 mass %, respectively, as the β-stabilizers.

According to tenth aspect of the invention, the α-β type titanium alloy of the ninth aspect may further include at lest one element selected from the group consisting of Sn: 1 to 5 mass %, Zr: 1 to 5 mass %, and Si: 0.2 to 0.5 mass %.

Other and further objects, features and advantages of the invention will appear more fully from the following description.

DETAILED DESCRIPTION OF THE PREFERRED EMBODIMENTS

In view of the problems in the related art as previously pointed out, the present inventors have pursued the study, particularly, centering on the titanium alloy composition for developing a titanium alloy excellent in both the strength and the hot workability in the following manner. Namely, while allowing the alloy to have an ordinary-temperature strength equivalent to, or exceeding that of a Ti-6Al-4V alloy most widely used as a high-strength titanium alloy at present, and ensuring a sufficient strength even in the vicinity of about 500° C., which is the general upper operating temperature limit, the flow stress at high temperatures of not less than around 800° C., at which hot working becomes difficult to perform for a general α-β type titanium alloy, is reduced, so that the hot workability is improved.

As a result, they found as follows. If the type and the content of each of the alloy elements is controlled favorably as described later, it is possible to obtain a titanium alloy which has an excellent hot workability while having a strength equivalent to, or exceeding that of a Ti-6Al-4V alloy in the operating temperature range of from ordinary temperature to about 500° C. In consequence, they have conceived the present invention.

Such a titanium alloy having both high strength and excellent hot workability can be obtained primarily by appropriately selecting and controlling the type and the amount of each of the alloy elements as described below. The distinctiveness of the titanium alloy of the present invention, not observable in the existing titanium alloys is expressed as the ratio of the ordinary-temperature strength and the flow stress upon greeble test under high temperature conditions. Namely, the titanium alloy of the present invention is characterized in that the ratio of A/B is 9 or more, wherein A denotes the tensile strength (the value determined in accordance with ASTM E8) at room temperature (25° C.) of the alloy which has been heated and annealed for 2 hours at 700° C., followed by natural air-cooling, and B denotes the flow stress (the value obtained by dividing the maximum load in a greeble test at a strain rate of 100/sec by the area of the parallel portion prior to the tensile test, assuming that a tensile test piece is deformed in such a manner that the length of the parallel portion thereof is changed uniformly) when the titanium alloy has been heated under an air atmosphere at 850° C. for 5 minutes, immediately followed by a greeble test at a strain rate of 100/sec.

Figure 1:
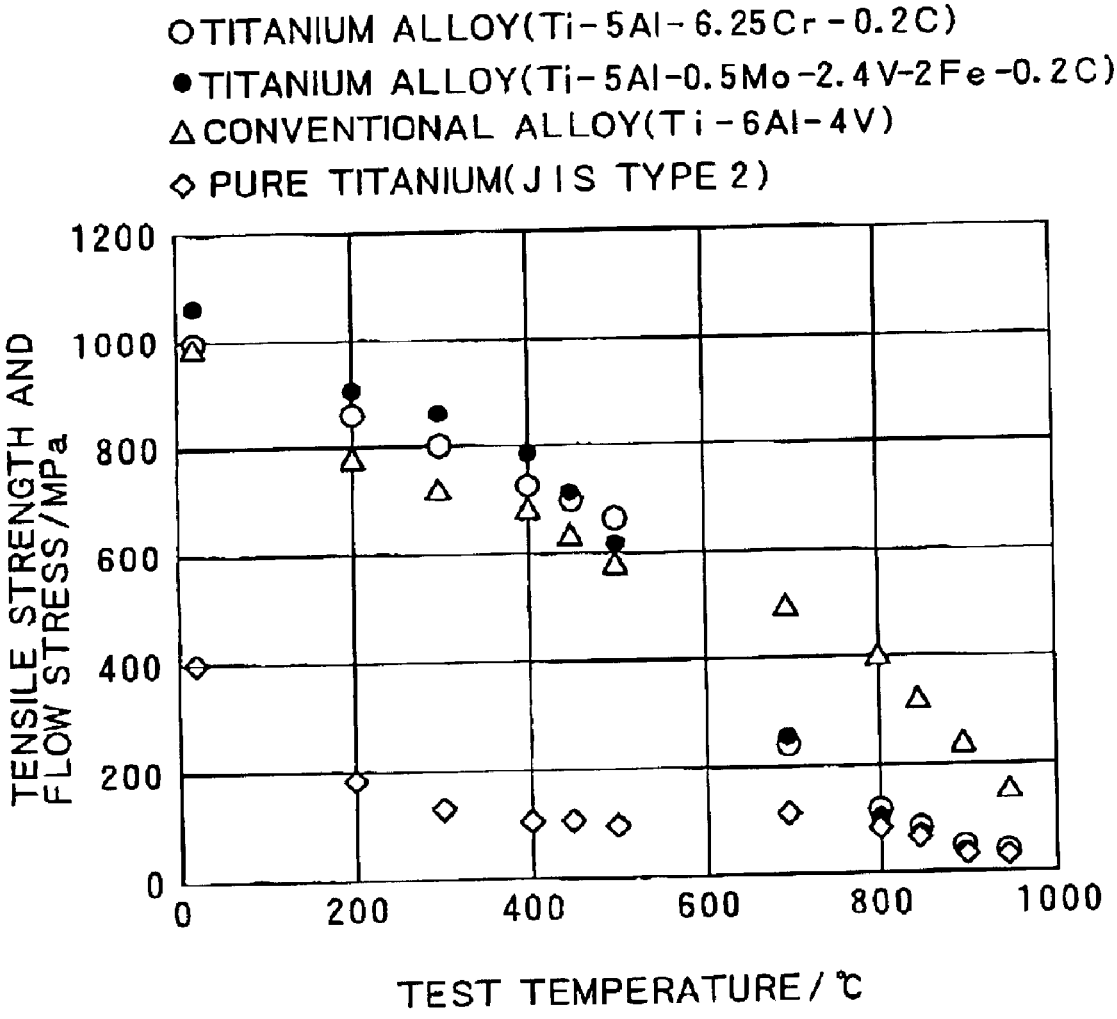
FIG. 1 is a graph for showing the relationship between the test temperature and the tensile strength (and the flow stress) of high-strength titanium alloys of the present invention and a conventional alloy.

Incidentally, FIG. 1 is a graph for showing the relationship between the test temperature, and the tensile strength and the flow stress upon greeble test for each of titanium alloys (1) and (2) of the present invention obtained in the following experiment examples, a Ti-6Al-4V alloy (conventional alloy) (3) which is a typical conventional high-strength titanium alloy, and a JIS type 2 alloy (pure titanium) (4). It is noted that the tensile strength at temperatures between ordinary temperature (25° C.) and 500° C. is determined in accordance with ASTM E8, and that the flow stress value at temperatures between 700° C. and 950° C. denotes the value determined by a greeble test at a strain rate of 100/sec.

As apparent from this figure, all of the titanium alloys of the present invention (1) and (2), the conventional alloy (3), and the pure titanium (4) are no different from each other in that they are reduced in strength (flow stress) with an increase in test temperature. Further, there is observed no large difference in strength-reducing tendency in a temperature range of from ordinary temperature to about 500° C. (i.e., the actual operating temperature range) between the conventional alloy (3) made of Ti-6Al-4V which is a typical high-strength titanium alloy, and the titanium alloys (1) and (2) in accordance with the present invention.

However, comparison in flow stress in the hot working temperature range, particularly in the α-β temperature range of 800 to 950° C. therebetween indicates as follows. The conventional alloy (3) keeps a considerably high strength (flow stress). In contrast, the titanium alloys (1) and (2) of the present invention each exhibit an extremely reduced strength (flow stress). This indicates as follows. The titanium alloy of the present invention exhibits high strength in the operating temperature range of from ordinary temperature to about 500° C., and exhibits excellent hot workability because of its considerably reduced flow stress due to a remarkable reduction in strength in the hot working temperature range.

In the present invention, the characteristics of the excellent high-temperature strength at temperatures of from ordinary temperature to about 500° C. and the low flow stress in the hot working temperature range (i.e., excellent hot workability) are defined for being quantified as the characteristics not observable in existing titanium alloys as follows. Namely, the alloy having such characteristics is the one having a ratio of "A/B≧9 or more", where A denotes [the tensile strength at room temperature (25° C.) of the alloy which has been heated and annealed at 700° C. for 2 hours, followed by natural air-cooling], and B denotes [the flow stress when the alloy has been heated in an air atmosphere at 850° C. for 5 minutes, and immediately thereafter, subjected a greeble test at a strain rate of 100/sec]. In the present invention, the alloy has an A/B of more preferably 10 or more, and further more preferably 12 or more.

Incidentally, the value of A/B determined by the foregoing measurement method of the Ti-6Al-4V alloy (conventional alloy) (3) which is a typical α-β type high-strength titanium alloy is [994/319=3.1] as also apparent from Table 3, and largely falls short of the requirement of "A/B≧9" defined in the present invention. It is noted that the characteristics of the JIS type 2 pure titanium (4) which is easier to hot work as compared with the conventional titanium alloy are also shown together in FIG. 1 and Tables 1 to 3 for reference purposes.

Namely, the high-strength titanium alloy of the present invention is characterized by the strength property of "A/B≧9" over the existing titanium alloys, and thus it is a novel high-strength titanium alloy clearly distinguishable from known titanium alloys. Further, considering the excellent strength property and hot workability, further the stability in structure control during hot working, or the like, the high-strength titanium alloy of the present invention preferably has, in addition to the foregoing strength property of "A/B≧9", the following characteristics:

(1) The tensile strength at room temperature (25° C.) after annealing at 700° C. is 895 MPa or more. This characteristic is the desirable characteristic for more clearly defining the rank as the high-strength titanium alloy. It is defined as the condition for satisfying the characteristics equivalent to those of the existing alloys from the fact that the lower limit value of the strength specified under the ASTM standard of the Ti-6Al-4V alloy, which is the foregoing existing typical high-strength titanium alloy, is 895 MPa. Incidentally, the high-strength titanium alloy in accordance with the present invention to be mentioned as examples described below exhibits a value of the ordinary-temperature strength in the vicinity of 1000 MPa equivalent to that of a general Ti-6Al-4V annealed material.

(2) The flow stress in greeble test at 850° C. is 200 MPa or less. This characteristic is the value obtained by more specifically converting the excellent hot workability not observable in existing high-strength titanium alloys into numerical value. For stably ensuring the excellent workability based on the sufficiently low flow stress under such a temperature condition which is assumed to be a general forging temperature, desirably, the flow stress under the temperature condition is 200 MPa or less, more preferably 150 MPa or less, and more further preferably 100 MPa or less. Incidentally, all of the flow stress values of the invention alloys shown in examples described below are 100 MPa or less.

(3) The tensile strength at 500° C. after annealing at 700° C. is not less than 45% of the tensile strength at room temperature (25° C.). This strength property is defined as an index for indicating the strength retentivity under the high temperature condition to which the invention alloy is exposed for being made practicable, i.e., the practical heat resistance property. The alloy having this characteristic denotes the one which is less reduced in strength even under high temperature condition of 500° C. level relative to the ordinary-temperature strength, and hence excellent in heat-resistant strength property. In order to ensure the heat-resistant strength property of higher level, desirably, 50% or more, and more preferably 55% or more is retained. Incidentally, the invention alloys (1) and (2) mentioned in the following examples both have not less than 55% thereof.

(4) The alloy is of an α-β type. The titanium alloy of the present invention desirably belongs to the α-β type as a requirement for ensuring a favorable strength-ductility balance and heat resistance. Thus, for the structure resulting in an α type titanium alloy, the hot flow stress tends to be increased. Whereas, for the structure resulting in a β type titanium alloy, the heat resistance tends to be inferior. Both cases are difficult to conform to the characteristics required of the high-strength high-workability titanium alloy intended in accordance with the present invention.

The method for manufacturing the high-strength titanium alloy showing the foregoing strength property has no particular restriction. However, as confirmed from experiments by the present inventors, the type and content of each of the alloy elements seem to be important. It is not possible to determine the type and content of a specific alloy element at the present time. However, it has been confirmed that the titanium alloy satisfying the requirement of the composition shown below is the alloy of a high performance satisfying the strength property defined in the present invention.

Namely, the preferred composition of the titanium alloy in accordance with the present invention contains Al in an amount of 3 to 7 mass % (more preferably 3.5 to 5.5 mass %) and C in an amount of 0.08 to 0.25 mass % (more preferably 0.10 to 0.22 mass %) as α-stabilizers, and a β-stabilizer in a Mo equivalence represented by the following equation of 3.25 to 10 mass % (more preferably 3.5 to 8.0 mass %).

$$\text{Mo equivalence}=\text{Mo(mass \%)}+(1/1.5)\text{V(mass \%)}+1.25\ \text{Cr (mass \%)}+2.5\ \text{Fe(mass \%)}$$

More specifically, it contains Al in an amount of 3 to 7 mass % (more preferably 3.5 to 5.5 mass %) and C in an amount of 0.08 to 0.25 mass % (more preferably 0.10 to 0.22 mass %, and further more preferably 0.15 to 0.20 mass %) as α-stabilizers, and Cr in an amount of 2 to 6 mass % (more preferably 3 to 5 mass %), and Fe in an amount of 0.3 to 2.0 mass % (more preferably 0.5 to 1.5 mass %) as β-stabilizers. Further, it has been confirmed that the titanium alloy containing at least one element selected from the group consisting of Sn: 1 to 5 mass %, Zr: 1 to 5 mass %, and Si: 0.2 to 0.8 mass % in addition to these elements is also capable of exhibiting excellent performances.

Incidentally, the reason for defining the preferred content of each constituent element recommended above is as follows. First, for the Al content, the lower limit value is recommended for ensuring the strength equivalent to that of Ti-6Al-4V. Whereas, the upper limit value is recommended as such an allowable limit that a rise in flow stress and a reduction in hot workability under the hot working conditions can be suppressed. Further, also for the C content, the lower limit value is recommended for ensuring the strength equivalent to that of Ti-6Al-4V. Whereas, the upper limit value is recommended as such an allowable limit that the hot ductility will not be degraded due to precipitation of a large amount of TiC.

Further, the reason for defining the respective lower limits of the Mo equivalence and the contents of Cr and Fe is similarly to ensure the strength equivalent to that of Ti-6Al-4V. The upper limit value is recommended as a requirement not to increase the flow stress during hot working and not to excessively reduce the β transformation point.

Further, for Sn, Zr, and Si, the lower limit is defined as such an amount as to be capable of exerting the strength-raising effect in the temperature range of from ordinary temperature to a level of 500° C. On the other hand, the upper limit value is recommended as such an amount as not to respectively deteriorate the hot ductility for Sn and Zr, and the ordinary-temperature ductility for Si.

Other examples of the titanium alloys to be preferably used in the present invention further include a "Ti-5Al-6.25Cr-0.2C alloy" and a "Ti-5Al-0.5Mo-2.4V-2Fe-0.2C alloy" as revealed in examples described below. Thus, it is also possible to allow other β-stabilizers such as V and Mo to be contained therein each in an appropriate amount in such a range that the β transformation point is not less than 850° C. The effects of these alloy elements considerably vary according to the type of each of the alloy elements and addition of two or more elements in combination, and further, the amount of these elements to be added. Therefore, the type of each of the alloy elements, the combined addition thereof, or the preferred addition amount, or the like may be appropriately selected and determined according to the alloy elements to be used.

However, the chemical components common to the titanium alloys of the foregoing compositions recommended in the present invention are characterized by having the following respective contents. The Al content is somewhat lower relative to that of the Ti-6Al-4V alloy which is a typical high-strength titanium alloy, and C is contained in a small amount. Then, the effects of such Al and C are presumed as follows. Namely, Al and C are the α-stabilizers as is known. In general, they contribute to the increase in high-temperature strength. However, if the addition amount is properly controlled, they do not cause a large reduction in strength associated with a rise in temperature up to temperatures of from room temperature to a level of 500° C. However, they suppress the rise in strength, and largely reduce the flow stress in a higher hot working temperature range. Particularly, C contributes to the solid solution strengthening up to the temperature range of from room temperature to a level of 500° C., but barely contributes to the improvement of the strengthening in the hot working temperature range. Further, C also has an effect of largely raising the β transformation point by being added in trace amounts. Therefore, C is considered to be a very useful element for the present invention.

Further, a second feature of the titanium alloy from the viewpoint of its composition lies in that proper amounts of Cr and Fe are contained therein as the β-stabilizers. Then, the effects of such Cr and Fe are presumed as follows.

Namely, as is known, Cr and Fe are the β-stabilizers. The β-stabilizers generally raise the strength and the flow stress. However, Cr and Fe, which are transition elements, undergo high-speed diffusion in Ti, and hence they do not contribute to the strengthening at high temperatures very much. Therefore, conceivably, proper control of the amounts of these elements to be added provides excellent hot workability with less flow stress under high-temperature forging or hot rolling conditions while retaining the high strength in the operating temperature range of from room temperature to a level of 500° C.

Figure 6A:
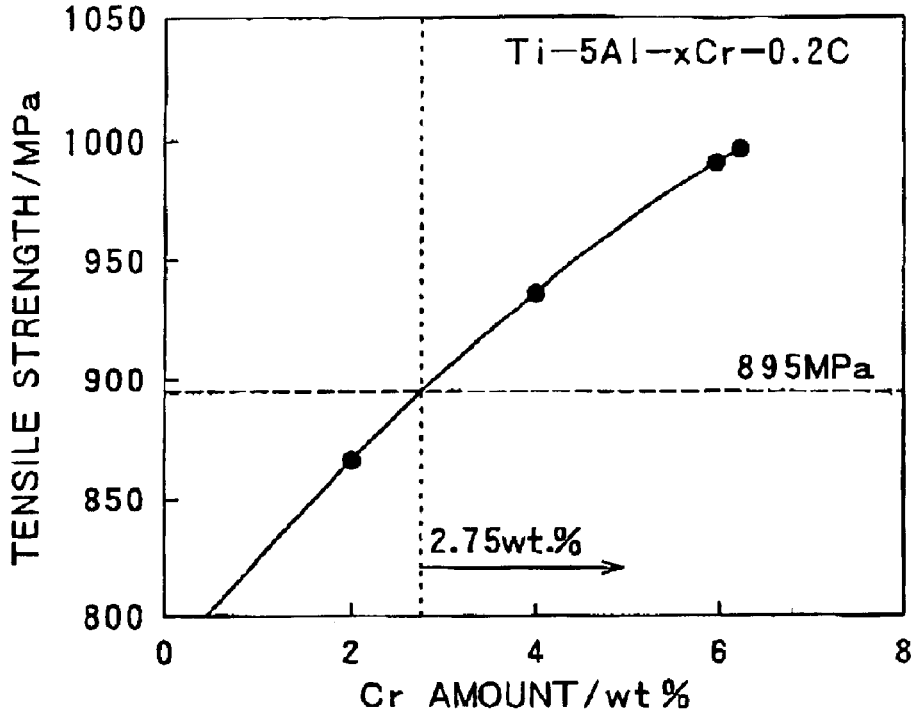
FIGS. 6A and 6B are graphs each for showing the relationship between the amount of a β-stabilizer to be added and the tensile strength.
Figure 6B:
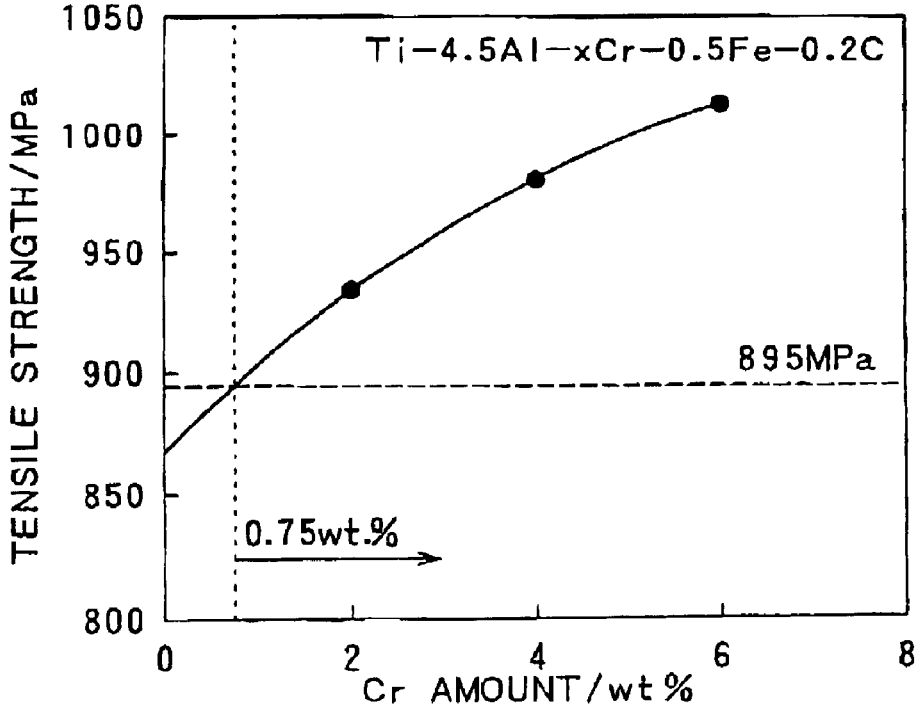

In the α-β type titanium alloy of the present invention, it is preferable that 0.08 to 0.25 mass % C and 4 to 5.5 mass % Al are contained as the α-stabilizers, and that the β-stabilizer is contained in an amount enough for the tensile strength at 25° C. after annealing at 700° C. to be not less than 895 MPa. The meaning of the wording "the β-stabilizer in an amount enough for the tensile strength at 25° C. after annealing at 700° C. to be not less than 895 MPa" will be described below. FIG. 6A shows, in a titanium alloy containing 0.2 mass % C and 5 mass % Al as the α-stabilizers, the results determined from experiments of the relationship between the amount of Cr to be further added thereto and the tensile strength after annealing at 700° C. Herein, only Cr is added as the β-stabilizer. As shown in FIG. 6A, when the Cr amount is not less than 2.75 mass %, the tensile strength is not less than 895 MPa. Therefore, "the β-stabilizer in an amount enough for the tensile strength at 25° C. after annealing at 700° C. to be not less than 895 MPa" when 0.2 mass % C and 5 mass % Al are contained therein as the α-stabilizers, and only Cr is contained therein as the β-stabilizer, is Cr in an amount of not less than 2.75%. FIG. 6B shows, in a titanium alloy containing 0.2 mass % C and 4.5 mass % Al as the α-stabilizers, and 0.5 mass % Fe as the β-stabilizer, the results determined from experiments of the relationship between the amount of Cr to be further added thereto and the tensile strength after annealing at 700° C. Considering similarly to the case of FIG. 6A, "the β-stabilizers in an amount enough for the tensile strength at 25° C. after annealing at 700° C. to be not less than 895 MPa" in this case are Fe in an amount of 0.5 mass % and Cr in an amount of not less than 0.75 mass %.

Figure 7:
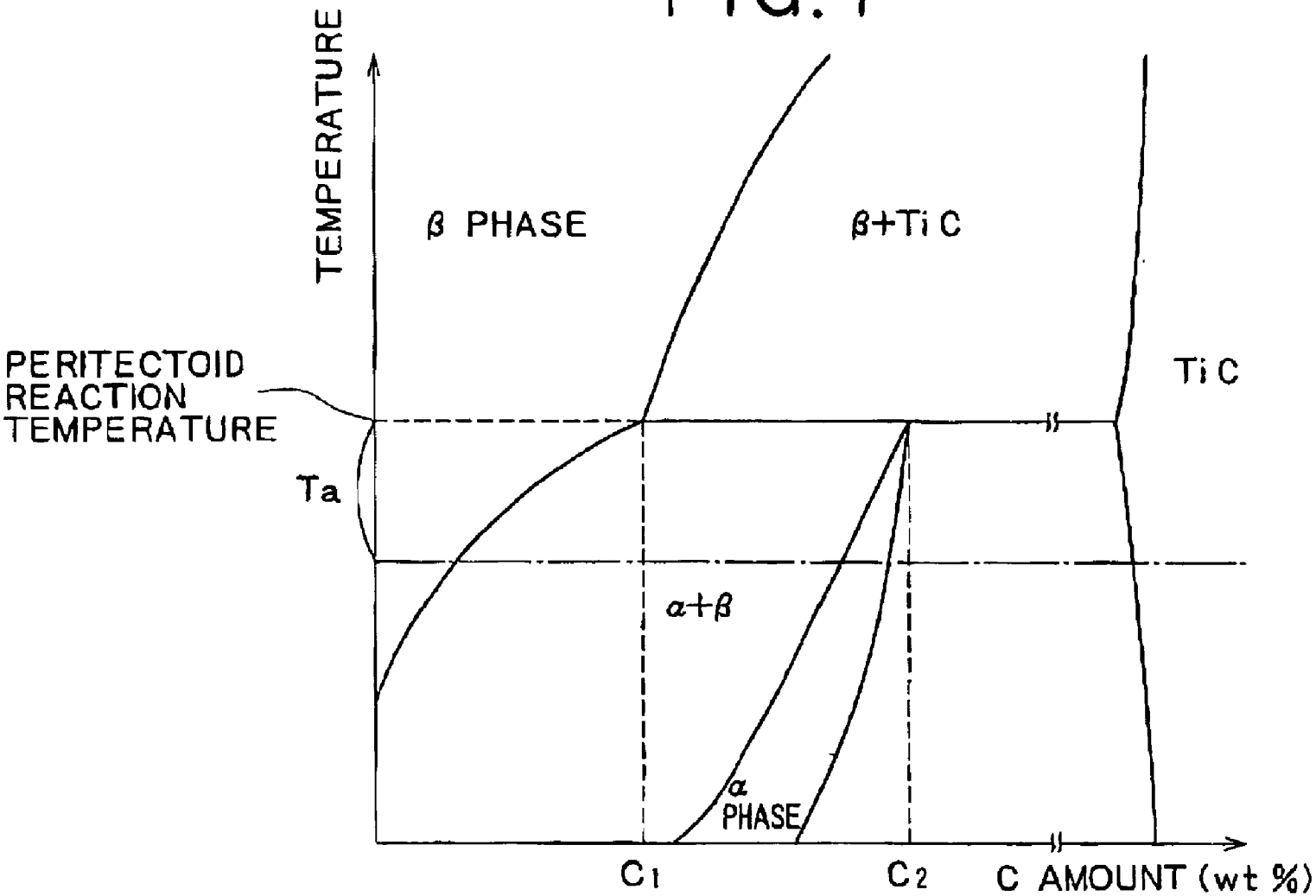
FIG. 7 is a diagram for schematically showing the binary system phase diagram of a titanium alloy and C.

The α-β type titanium alloy of the present invention is characterized in that the peritectoid reaction temperature in the pseudo-binary system phase diagram of the titanium alloy as the base and C is more than 900° C. FIG. 7 shows the pseudo-binary system phase diagram of the titanium alloy as the base and C. In the diagram, the position of the peritectoid reaction temperature is shown. The binary system phase diagram of the titanium alloy and C varies according to the composition of the titanium alloy. However, the basic pattern is the same. Accordingly, it is schematically shown in this diagram. The peritectoid reaction temperature of the titanium alloy is generally determined by the contents of α-stabilizer and β-stabilizer. Therefore, for the α-β type titanium alloy of the present invention, it is possible to implement the peritecoid reaction temperature of more that 900° C. by adjusting the contents of Al, C, Mo, V, Cr and Fe. The peritectoid reaction temperature of more than 900° C. becomes the, premise for adopting such a hot working method (described later) as to suppress the precipitation of TiC and to improve the fatigue characteristic.

Figure 8:
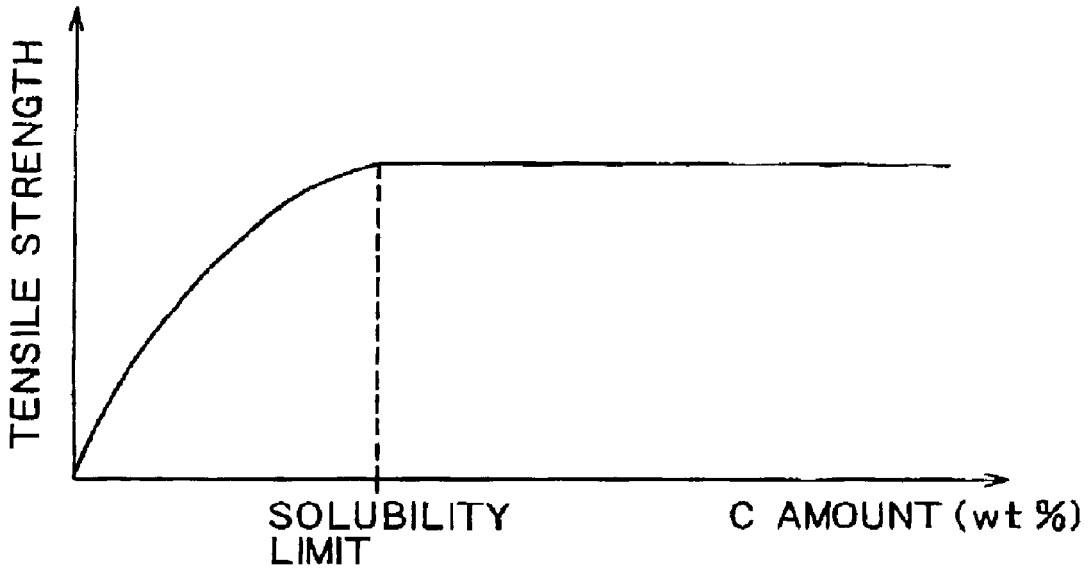
FIG. 8 is a diagram for schematically showing the relationship between the amount of C in solid solution in the titanium alloy and the tensile strength.

The desirable C content in the present invention can be characterized as follows. In the titanium alloy of the present invention, a proper amount of C is positively allowed to be contained as a constituent element as described above. More specifically, as schematically shown in FIG. 8, there is a relationship such that the tensile strength at room temperature to about 500° C. increases with an increase in C content, i.e., an increase in amount of C to be solid-solved, and that the tensile strength becomes constant when the C content exceeds the solubility limit of C because the amount of solid-solved C reaches saturation. The present invention aims to make full use of the solid solution strengthening at room temperature to about 500° C. by C with addition of C in an amount of not less than the solubility limit. However, conversely, there is a concern that TiC is formed in the alloy matrix derived from the positive addition of C, and that this may become a precipitate to deteriorate the fatigue characteristic of the titanium alloy. Thus, a study was made on the effect of the TiC precipitate, which may be formed in the titanium alloy, exerted on the fatigue characteristic. This study has indicated that the smaller the amount of Tic precipitate in the titanium alloy matrix is, the more the fatigue characteristic is improved as apparent from examples described later. It has been shown that, especially if the alloy is so configured that TiC, which is the TiC precipitate in the titanium alloy matrix, has a maximum particle size of not more than 15 μm and that the area ratio thereof is not more than 3%, it is preferred as the titanium alloy of the present invention.

Incidentally, as also apparent from examples described later, out of the titanium alloys in accordance with the present invention, the one having a TiC area ratio of more than 3% has only a fatigue characteristic at the same level of that of a Ti-6Al-4V alloy which is a typical conventional high-strength titanium alloy. However, it has been confirmed that the one having a TiC area ratio of not more than 3%, and more preferably not more than 1.0% can exert its characteristics surpassing those of the conventional Ti-6Al-4V alloy.

It has been shown that, in order to add C in a sufficient amount and to minimize the precipitation of TiC, such hot working as described below is desirably performed. Namely, it has been shown that, for heat-treating and hot working a titanium alloy including proper components, hot working is desirably performed such that the total heating time at 900° C. to less than the peritectoid reaction temperature is not less than 4 hours, and such that the total reduction is not less than 30% (preferably, not less than 50%) prior to annealing at temperatures of from 700° C. to 900° C. (preferably 700 to 850° C.). If a proper amount of C is added, heating up to not less than the peritectoid reaction temperature causes β+TiC, so that TiC is precipitated. However, heating up to lower than the peritectoid reaction temperature can disappear TiC. Such an amount of C ranges from not less than the carbon solubility limit in β phase at the peritectoid reaction temperature to less than the amount of C in the composition at the peritectoid reaction point (peritectoid composition). Namely, it ranges between C1 and C2 shown in FIG. 7. In the titanium alloy containing C in an amount within such a range, it is possible to render the whole C into the solid solution state by sufficiently heating and holding at a temperature of less than the peritectoid reaction temperature capable of disappearing TiC and not less than 900° C. causing faster diffusion. Incidentally, the reason why the total reduction is required to be not less than 30% is that the required reduction for obtaining equiaxed structure is not less than 30%. As described above, it is possible to define the range of the desirable C amount in the present invention as not less than the carbon solubility limit in β phase at the peritectoid reaction temperature and less than the C amount in the composition at the peritectoid reaction point (peritectoid composition).

Incidentally, since a relatively large amount of C has been intentionally added to the titanium alloy of the present invention, even C yet to reach supersaturation can exist as TiC at the peritectoid reaction temperature or less according to the heating conditions. However, if the foregoing heat treatment conditions are adopted, it is possible to render the excess TiC into a thermally stable state, i.e., to completely solid-solve C in an amount of not more than the solubility limit. In consequence, it is possible to minimize the amount of C to be present in form of TiC.

EXAMPLES

Below, the present invention will be described more specifically by way of examples, which should not be construed as limiting the scope of the present invention. The present invention is also capable of being practiced or carried out with changes and modifications properly made within the range applicable to the foregoing and following gists. Such changes and modifications are all included in the technical scope of the present invention.

Example 1

As typical titanium alloys in accordance with the present invention, a Ti-5Al-6.25Cr-0.2C alloy (1) (peritectoid reaction temperature: 915° C.), a Ti-5Al-0.5Mo-2.4V-2Fe-0.2C alloy (2) (peritectoid reaction temperature: 967° C.), and a Ti-4.5Al-4Cr-0.5Fe-0.2C alloy (3) (peritectoid reaction temperature: 970° C.) were melt-produced and cast by a cold crucible induction melting method (CCIM) to manufacture 25-kg ingots. Each of the resulting ingots of the alloys (1) and (2) were heated to 1000° C. as a preferred heating temperature slightly lower than normal, followed by preforging at a working ratio of 80%. Then, the ingots were heated to 850° C., followed by finish forging at a working ratio of 75%. Whereas, each of the resulting ingots of the alloy (3) was heated at 850° C. for 2 hours, followed by forging at a working ratio of 92%. Thereafter, all the ingots of the alloys (1) to (3) were heated at 700° C. for 2 hours, followed by air cooling, thus to be annealed. In consequence, forged round bars were manufactured.

Figure 2:
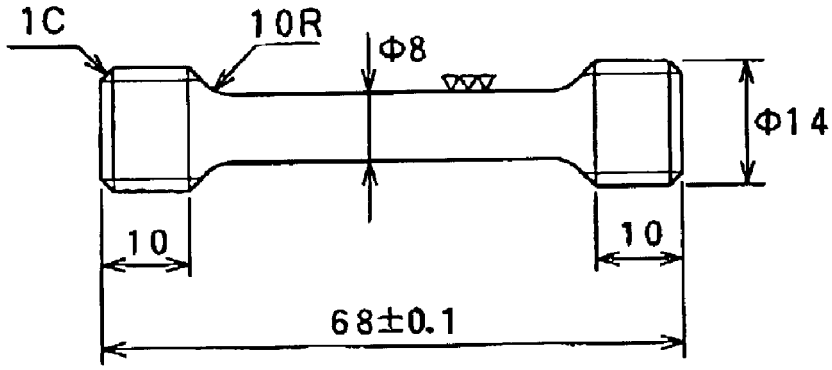
FIG. 2 is an explanatory diagram for showing the geometry of a test piece for measuring the flow stress in a high temperature range.

By using the forged materials, their respective tensile strengths at room temperature to 500° C. (in accordance with ASTM E8) were determined. Further, a test piece with the geometry shown in FIG. 2 was cut out from each of the ingots. Each test piece was heated under an air atmosphere at 700 to 950° C. for 5 minutes. Immediately thereafter, a greeble test was performed at a strain rate of 100/sec by means of a greeble tester (tradename: "Thermecmaster-Z" manufactured by Fuji Electronic Industrial Co., Ltd.) to determine the flow stress. It is noted that the flow stress value was calculated by dividing the maximum load obtained from the greeble test by the area of the parallel portion prior to the test. The results are shown in Table 1.

Further, by using each of the ingot pieces (1) and (2) obtained above, annealing for preforging, finish forging, and equiaxial crystallization was conducted under the foregoing conditions. Whereas, by using the ingot pieces (3), forging was performed under the same conditions as described above. Each of the resulting pieces was heated and annealed at 700° C. for 2 hours, followed by cooling at a rate of 0.1 to 0.2° C./sec. Then, it was measured for its tensile strength at room temperature (25° C.) to 500° C. by means of a tensile tester (tradename: "AG-E230kN autograph tensile tester) manufactured by Shimadzu Corp in accordance with ASTM E8. The results are shown in Table 2.

TABLE 1

| | | Maximum flow stress (MPa) at each test temperature | | | | |
|---|---|---|---|---|---|---|
| | Alloy composition (mass%) | 700° C. | 800° C. | 850° C. | 900° C. | 950° C. |
| Titanium alloy (1) | Ti-5Al-6.25Cr-0.2C | 233 | 104 | 69 | 34 | 28.5 |
| Titanium alloy (2) | Ti-5Al-0.5Mo-2.4V-2Fe-0.2C | 247 | 93 | 64 | 34 | 27 |
| Titanium alloy (3) | Ti-4.5Al-4Cr-0.5Fe-0.2C | 222 | 103 | 53 | 33 | 27 |
| Conventional alloy (4) | Ti-6Al-4V | 493 | 398 | 319 | 236 | 146 |
| Pure titanium (5) | JIS type 2 | 100 | 75 | 50 | 25 | 22.5 |

TABLE 2

| | | Tensile strength (MPa) at each test temperature in accordance with ASTM | | | | | |
|---|---|---|---|---|---|---|---|
| | Alloy composition (mass%) | R.T.(25° C.) | 200° C. | 300° C. | 400° C. | 450° C. | 500° C. |
| Titanium alloy (1) | Ti-5Al-6.25Cr-0.2C | 997 | 864 | 797 | 728 | 703 | 663 |
| Titanium alloy (2) | Ti-5Al-0.5Mo-2.4V-2Fe-0.2C | 1071 | 909 | 863 | 789 | 712 | 614 |

TABLE 2-continued

| | Alloy composition (mass%) | Tensile strength (MPa) at each test temperature in accordance with ASTM | | | | | |
|---|---|---|---|---|---|---|---|
| | | R.T.(25° C.) | 200° C. | 300° C. | 400° C. | 450° C. | 500° C. |
| Titanium alloy (3) | Ti-4.5Al-4Cr-0.5Fe-0.2C | 982 | 789 | 745 | 698 | 661 | 584 |
| Conventional alloy (4) | Ti-6Al-4V | 994 | 793 | 726 | 681 | 637 | 583 |
| Pure titanium 5 | JIS type 2 | 402 | 186 | 123 | 98 | 93 | 88 |

FIG. 1 graphically represents the results of Tables 1 and 2 described above as the relationship between the test temperature (° C.), and the tensile strength (ordinary temperature to 500° C.) and the flow stress (700 to 950° C.). As for the results of the alloy (3), the graphical expression thereof is omitted. Incidentally, in Tables 1 and 2, and FIG. 1, the measurement results of a Ti-6Al-4V alloy (conventional alloy (4)) which is a typical conventional titanium alloy and a JIS type 2 alloy (pure titanium (5)) are shown together.

As also apparent from Tables 1 and 2, and FIG. 1, the conventional alloy (4) which is a typical high-strength titanium alloy has high strength in the operating temperature range of from ordinary temperature to 500° C. On the other hand, it retains considerably high strength also in a high temperature range of from 700 to 950° C., and hence it lacks hot workability because of its high flow stress.

In contrast to these, the titanium alloys (1) to (3) of the present invention have high strength exceeding that of the conventional alloy (4) in the operating temperature range of from ordinary temperature to 500° C. In addition, the flow stress in a high temperature range of from 800 to 950° C. intended for hot working is as low as that of the easily workable pure titanium (5). Thus, it is indicated that they are also very excellent in hot workability.

Namely, the titanium alloys (1) to (3) satisfying the specified requirements of the present invention are compared with the conventional alloy (4) and the pure titanium (5) for the strength in the operating temperature range and the flow stress in the hot working temperature range. The results of the comparison are as shown in Table 3 below, indicating that all of the titanium alloys (1) to (3) of the present invention have both high strength and excellent hot workability.

TABLE 3

| | Titanium alloy (1) | Titanium alloy (2) | Titanium alloy (3) | Conventional alloy (4) | Pure titanium (5) |
|---|---|---|---|---|---|
| Ordinary-temperature (25° C.) strength (MPa):A | 997 | 1071 | 982 | 994 | 402 |
| 500° C. tensile strength (MPa): C | 703 | 712 | 584 | 637 | 93 |
| 850° C. flow stress (MPa): B | 69 | 64 | 53 | 319 | 50 |
| A/B | 14.5 | 16.7 | 18.5 | 3.12 | 8.04 |
| C/A(%) | 70.5 | 66.5 | 59.5 | 64.1 | 23.1 |

Example 2

By using the titanium alloys having their respective compositions shown in Table 4 below, 25-kg ingots were manufactured by adopting a cold crucible induction melting method. Each of the resulting ingots was heated to 850° C., and then a forged round bar with a diameter of 25 mm was manufactured. The resulting round bar was annealed at 700° C. for 2 hours. Subsequently, the annealed material was measured for its tensile strength at room temperature (in accordance with ASTM E8) and its flow stress at 850° C. by the same method. The results are shown together in Table 4.

TABLE 4

| Ref. No. | Alloy composition (mass%) | β transformation point (° C.) | Tensile strength (MPa) of 700° C. annealed material 25° C. tensile strength (A) | 850° C. flow stress (B) (MPa) of 1000° C. × 30 min/AC material | A/B |
|---|---|---|---|---|---|
| 1 | Ti-4.5Al-4Cr-0.5Fe | 907 | 690 | 55 | 12.5 |
| 2 | Ti-4.5Al-4Cr-0.5Fe-0.1C | 945 | 904 | 55 | 16.4 |
| 3 | Ti-4.5Al-4Cr-0.5Fe-0.15C | 970 | 976 | 53 | 18.4 |
| 4 | Ti-4.5Al-4Cr-0.5Fe-0.2C | 970 | 982 | 53 | 18.5 |
| 5 | Ti-4.5Al-4Cr-0.5Fe-0.25C | 970 | 900 | 55 | 16.4 |
| 6 | Ti-4.5Al-4Cr-0.5Fe-0.3C | 970 | 845 | 56 | 15.1 |

As also apparent from Table 4, all the titanium alloys except for the alloy indicated by a reference numeral 1 and 6 are the titanium alloys satisfying the specified requirements of the present invention. It is indicated that these alloys not only have high tensile strengths at 25° C. and 500° C., but also show relatively low flow stress upon greeble test at 850° C., and hence have excellent hot workability.

Figure 3:
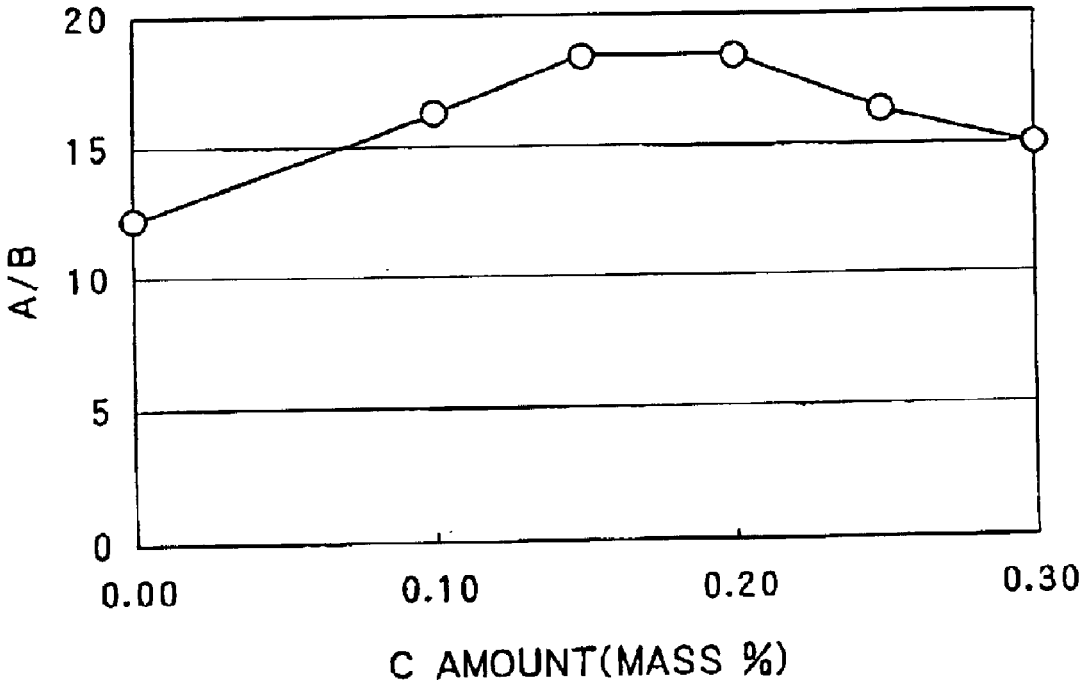
FIG. 3 is a graph for showing the effect of the C content exerted on the ratio (A/B) between the room-temperature strength and the high-temperature flow stress upon stretching in the high-strength titanium alloy in accordance with the present invention.

Incidentally, FIG. 3 is a graph for systematically showing, for the titanium alloys shown in Table 4 above, the effect of the C content exerted on the ratio (A/B) between the room-temperature (25° C.) strength and the flow stress at 850° C. of each of the titanium alloys. As also apparent from this figure, the C content is very important for raising the (A/B) ratio, and for establishing the compatibility between the high strength at room temperature and the excellent hot workability. As is indicated, it is possible to effectively raise the (A/B) ratio by preferably setting the C content to be in the range of from 0.08 to 0.25%.

Example 3

Melt-producing, casting, forging, and annealing were performed in the precisely same manner as in Example 1, except that the alloys indicated by reference characters a and b shown in Table 5 were used as examples of the titanium alloys intended principally for the enhancement in strength at from room temperature to 500° C. Each of the resulting annealed materials was measured in the same manner for the ordinary-temperature (25° C.) and high-temperature (500° C.) tensile strengths and the flow stress upon greeble test at 850° C. In consequence, the results shown together in Table 5 were obtained. Further, in Table 5, the values in the case where a Ti-6Al-4V alloy was used as a typical conventional alloy are shown together for comparison.

TABLE 5

| Ref. No. | Alloy composition (mass%) | β transformation point (° C.) | Tensile strength (MPa) of 700° C. annealed material: 25° C. tensile strength (A) | Tensile strength (MPa) of 700° C. annealed material: 500° C. tensile strength (C) | 850° C. flow stress (B) (MPa) of 1000° C. × 30 min/AC material | A/B | C/A(%) |
|---|---|---|---|---|---|---|---|
| a | Ti-6Al-4Sn-4Cr-0.5Fe-0.2Si-0.2C | 1015 | 1354 | 967 | 131 | 10.3 | 71.4 |
| b | Ti-6Al-4Sn-6Cr-0.5Fe-0.2Si-0.2C | 980 | 1508 | 1086 | 143 | 10.5 | 72.0 |
| c | Ti-6Al-4V | 995 | 994 | 583 | 319 | 3.1 | 58.7 |

As also apparent from Table 5, the titanium alloys indicated by the reference characters a and b satisfying the specified requirements of the present invention have significantly excellent tensile strength as compared with the conventional alloy indicated by the reference character c which is a typical high-strength titanium alloy. In spite of this, it is indicated that they show a low flow stress at 850° C., and hence have excellent hot workability.

Example 4

The Ti-4.5Al-4Cr-0.5Fe-0.2C alloy (peritectoid reaction temperature; 970° C.) out of the titanium alloys shown in Example 2 above was heated at 940° C. for 4 hours, followed by forging at a working ratio of 92%. The resulting forged material was subjected to annealing by 2-hour heating/air-cooling at 700° C. to manufacture a forged round bar. The resulting five round bars according to the production method above and the four forged round bars of the same compositions obtained in Example 1 above (the heating conditions before forging for both bars are 850° C. and 2 hours) were each checked for the relationship between the area ratio of TiC occurring in the cross section and the fatigue strength (in accordance with ASTM E466: stress ratio 0.1).

The method for measuring the TiC area ratio and the fatigue strength is as follows.

[TiC area ratio (%)]

Figure 4:
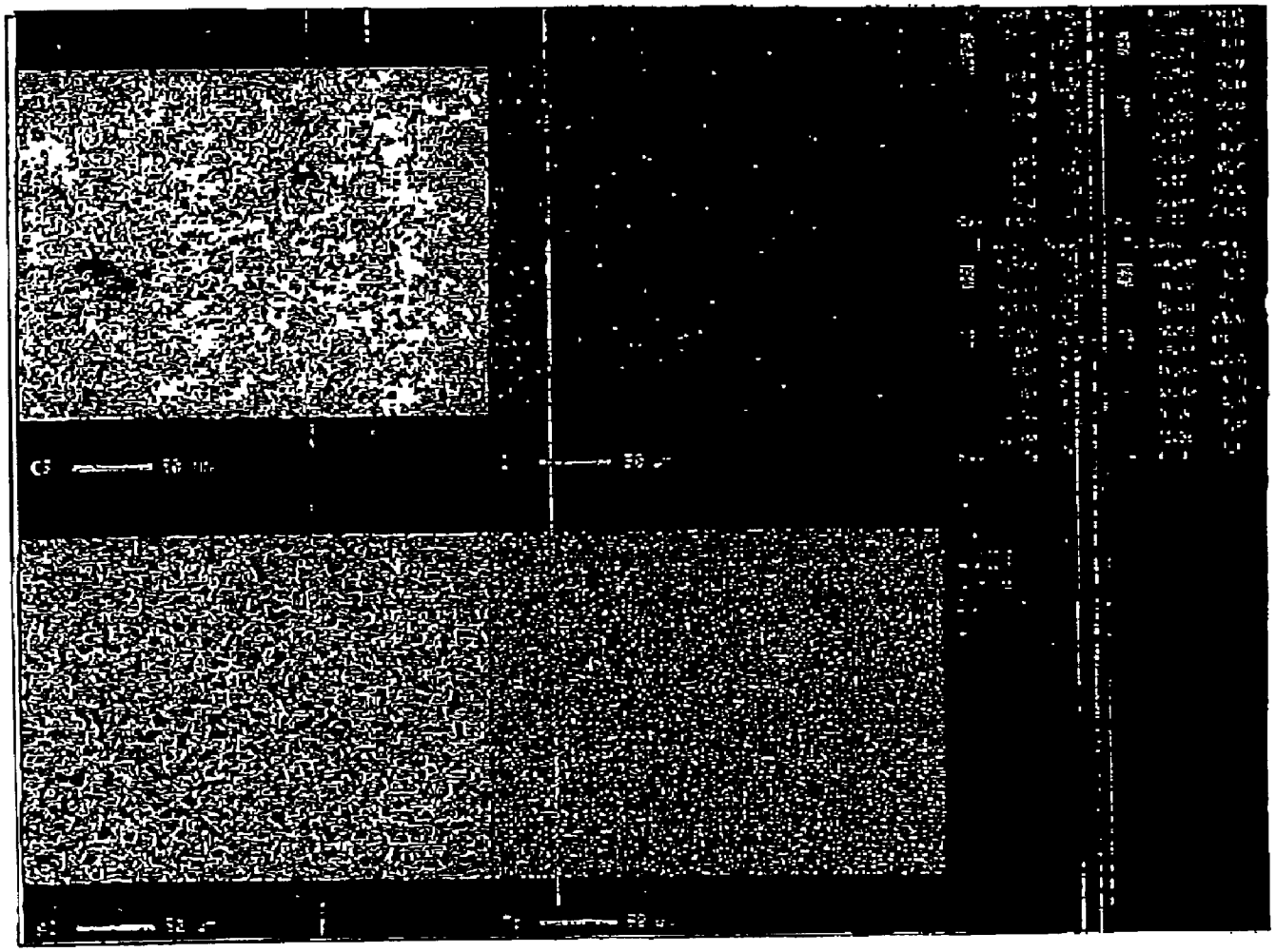
FIG. 4 is a cross-sectional EPMA photograph of a high-strength titanium alloy with a TiC area ratio of 0%.
Figure 5:
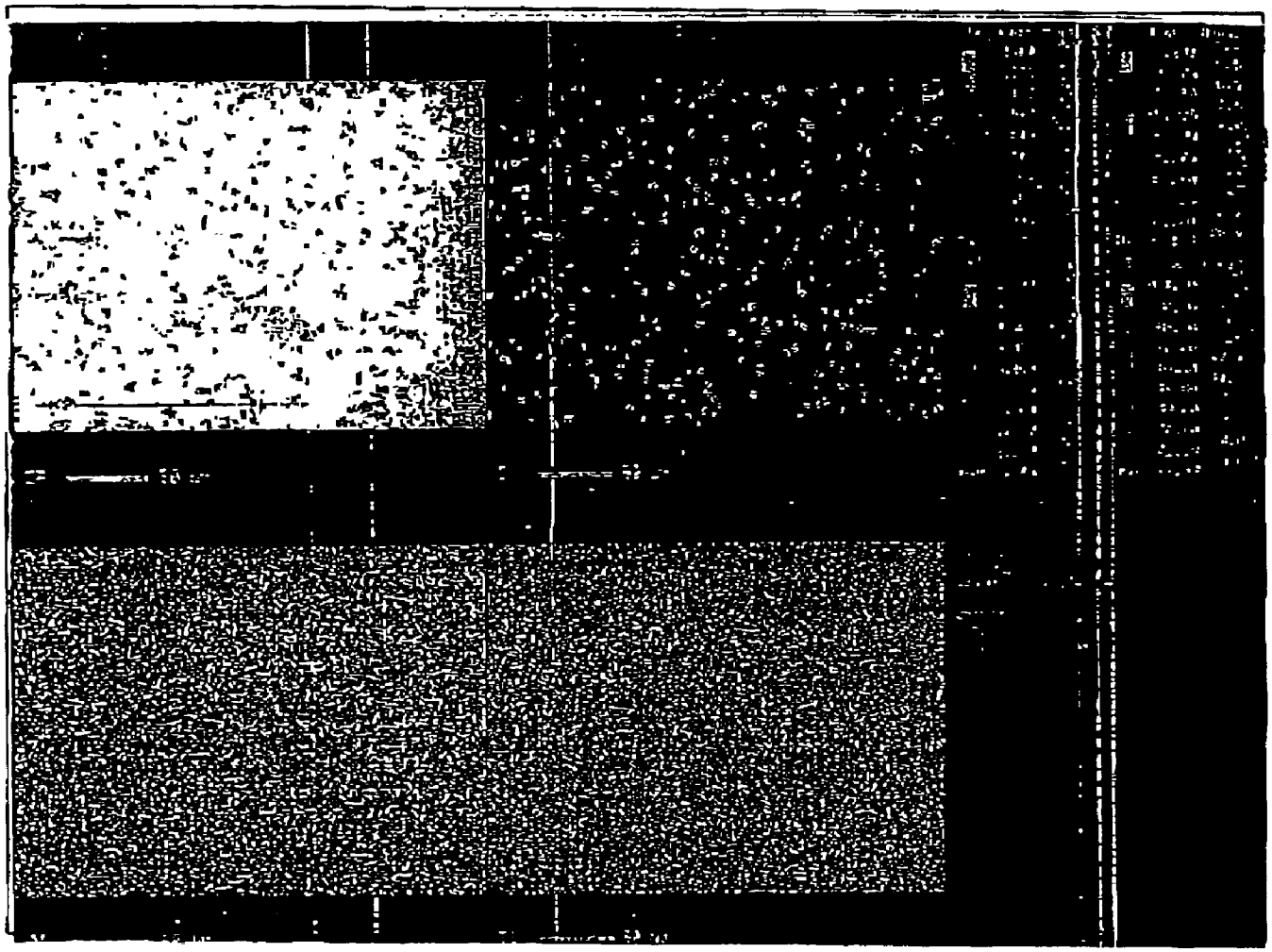
FIG. 5 is a cross-sectional EPMA photograph of a high-strength titanium alloy with a TiC area ratio of 3%.

Five spots in the cross section of each of the titanium alloy under test are subjected to surface analysis for 10000-$\mu m^2$ range at a magnification of 300 times or more by EPMA to determine the concentration distributions of C and Al. The area ratio (A) of the C-concentrated region and the area ratio (B) of the Al-concentrated region in the resulting concentration distribution diagram are determined by image analysis. The difference between the area ratios (A–B) is defined as the area ratio of TiC. Incidentally, the photographs provided as FIGS. 4 and 5 are the cross-sectional EPMA photographs of the titanium alloys. FIGS. 4 and 5 are the EPMA photographs for the titanium alloy with a TiC area ratio of 0% and the titanium alloy with a TiC area ratio of 3%, respectively.

The results areas shown in Table 6. The fatigue strength of the titanium alloy in accordance with the present invention considerably varies according to the TiC area ratio occurring in the cross section. Then, the fatigue limit apparently shows a decreasing trend with an increase in TiC area ratio. It is indicated that a high-level fatigue characteristic can be ensured with stability if the area ratio is controlled to be not more than 3%.

As to the fatigue strength, cycles to failure, i.e. number of tests until a break occurred, was measured by a fatigue test (stress ratio:0.1, maximum stress:800 MPa). The fatigue stress was evaluated by the cycles to failure. In the fatigue test, when a break did not occur after $10^7$ cycles of the test, it was estimated that more cycles of the test would not cause a break, and it was judged as "runout" (no break). In Table 6, the results of Nos. 1 to 4 were runout and that of No. 5 was that a break did not occur after approximately $10^7$ cycles of the test. Thus, in the samples of Nos. 1 to 5 which are within the range defined in the present invention, the fatigue strengths are favorable.

TABLE 6

Maximum stress = 800 MPa, Stress ratio = 0.1

| No. | Area Ratio of TiC (%) | Maximum diameter of TiC(%) | Cycles to failure | Heating temperature and time |
|---|---|---|---|---|
| 1 | 0 | 0 | Runout | 940° C. × 4 Hr. |
| 2 | 1 | 10 | Runout | 940° C. × 4 Hr. |
| 3 | 2 | 6 | Runout | 940° C. × 4 Hr. |
| 4 | 3 | 5 | Runout | 940° C. × 4 Hr. |
| 5 | 3 | 7 | $6.8 \times 10^6$ | 940° C. × 4 Hr. |
| 6 | 3 | 16 | $3.2 \times 10^5$ | 850° C. × 2 Hr. |
| 7 | 4 | 9 | $4.5 \times 10^6$ | 850° C. × 2 Hr. |
| 8 | 4 | 15 | $2.4 \times 10^5$ | 850° C. × 2 Hr. |
| 9 | 5 | 6 | $1.7 \times 10^5$ | 850° C. × 2 Hr. |

The foregoing invention has been described in terms of preferred embodiments. However, those skilled, in the art will recognize that many variations of such embodiments exist. Such variations are intended to be within the scope of the present invention and the appended claims.

What is claimed is:

1. An α-β type titanium alloy, comprising

C in an amount of 0.08 to 0.25 mass %; and at least one of Cr in an amount of 2.0 to 6.0 mass % and Fe in an amount of 0.3 to 2.0 mass %, wherein the ratio between the tensile strength at 25° C. after annealing at 700° C. and the flow stress upon greeble test at 850° C. is not less than 9.

2. The α-β type titanium alloy according to claim 1, wherein the tensile strength at 500° C. after annealing at 700° C. is not less than 45% of the tensile strength at a room temperature of 25° C.

3. The α-β type titanium allow according to claim 1, further comprising

Al in an amount of 4 to 5.5 mass %, and a β-stabilizer in an amount enough for the tensile strength at 25° C. after annealing at 700° C. to be not less than 895 MPa.

4. The α-β type titanium alloy according to claim 1, wherein the peritectoid reaction temperature in a pseudo-binary system phase diagram of the titanium alloy as a base and C is more than 900° C.

5. The α-β type titanium alloy according to claim 1, wherein the amount of C contained in the alloy is not less than the solubility limit in β phase at the peritectoid reaction temperature in a pseudo-binary system phase diagram of the titanium alloy as a base and C and less than the C amount in the peritectoid composition.

6. The α-β type titanium alloy according to claim 1, wherein the maximum particle size of TiC present in a titanium alloy matrix is not more than 15 μm, and the area ratio of the TiC is not more than 3%.

7. The α-β type titanium alloy according to claim 4, wherein prior to annealing at 700 to 900° C., hot working is performed such that the total heating time at 900° C. to the peritectoid reaction temperature is not less than 4 hours, and such that the total reduction is not less than 30%.

8. The α-β type titanium alloy according to claim 1, further comprising Al in an amount of 3.0 to 7.0 mass %, and a β-stabilizer in a Mo equivalence of 3.25 to 10 mass %, wherein Mo equivalence=Mo (mass %)+(1/1.5) V (mass %)+1.25 Cr (mass %)+2.5 Fe (mass %).

9. The α-β type titanium alloy according to claim 8, wherein Cr and Fe are contained in an amount of 2.0 to 6.0 mass % and in an amount of 3.0 to 2.0 mass %, respectively, as the β-stabilizers.

10. The α-β type titanium alloy according to claim 9, further comprising at least one element selected from the group consisting of Sn: 1 to 5 mass %, Zr0: 1 to 5 mass %, and Si: 0.2 to 0.5 mass %.

11. The α-β type titanium alloy according to claim 1, wherein the alloy comprises Cr in an amount of 2.0 to 6.0 mass %.

12. The α-β type titanium alloy according to claim 1, wherein the alloy comprises Fe in an amount of 3.0 to 2.0 mass %.

13. A method of making an α-β type titanium alloy, the method comprising melting a mixture comprising Ti, C and at least one of Cr and Fe; and producing the α-β type titanium alloy of claim 1.

* * * * *

UNITED STATES PATENT AND TRADEMARK OFFICE

CERTIFICATE OF CORRECTION

PATENT NO. : 6,849,231 B2
DATED : February 1, 2005
INVENTOR(S) : Kojima et al.

It is certified that error appears in the above-identified patent and that said Letters Patent is hereby corrected as shown below:

Title page,
Item [73], Assignee, should read:
-- [73] Assignee: Kabushiki Kaisha Kobe Seiko Sho
(Kobe Steel, Ltd.) Kobe (JP) --

Signed and Sealed this

Tenth Day of May, 2005

JON W. DUDAS
*Director of the United States Patent and Trademark Office*